US010655933B2

(12) United States Patent
Jeung et al.

(10) Patent No.: US 10,655,933 B2
(45) **Date of Patent: *May 19, 2020**

(54) DOT SIGHT DEVICE

(71) Applicant: Bo Sun Jeung, Bucheon-si, Gyeonggi-do (KR)

(72) Inventors: Bo Sun Jeung, Bucheon-si (KR); In Jung, Bucheon-si (KR); Dong Hee Lee, Seongnam-si (KR)

(73) Assignee: Bo Sun Jeung, Bucheon-si, Gyeonggi-Do (KR)

( * ) Notice: Subject to any disclaimer, the term of this patent is extended or adjusted under 35 U.S.C. 154(b) by 71 days.

This patent is subject to a terminal disclaimer.

(21) Appl. No.: 15/971,396

(22) Filed: May 4, 2018

(65) Prior Publication Data

US 2018/0252497 A1 Sep. 6, 2018

Related U.S. Application Data

(63) Continuation of application No. 15/673,371, filed on Aug. 9, 2017, now Pat. No. 10,006,741.

(30) Foreign Application Priority Data

Aug. 9, 2016 (KR) ..... 10-2016-0101328

(51) Int. Cl.

| | |
|---|---|
| ***F41G 1/34*** | (2006.01) |
| ***F41G 3/00*** | (2006.01) |
| ***F41G 1/30*** | (2006.01) |

(52) U.S. Cl.

CPC ..... *F41G 1/345* (2013.01); *F41G 1/30* (2013.01); *F41G 3/00* (2013.01)

(58) Field of Classification Search

CPC ... F41G 1/345; F41G 1/30; F41G 1/32; F41G 1/34; F41G 3/00

See application file for complete search history.

(56) References Cited

U.S. PATENT DOCUMENTS

| | | | |
|---|---|---|---|
| 5,594,584 | A | 1/1997 | Kay et al. |
| 7,234,265 | B1 | 6/2007 | Cheng et al. |
| 8,087,196 | B2 | 1/2012 | Jung et al. |
| 8,393,109 | B2 | 3/2013 | Gilmore |

(Continued)

FOREIGN PATENT DOCUMENTS

KR 100906159 B1 7/2009

*Primary Examiner* — J. Woodrow Eldred

(74) *Attorney, Agent, or Firm* — Baker & McKenzie

(57) ABSTRACT

An exemplary dot sight device includes a sight body, an illumination unit, an optical system, first, second and third movement blocks, and first, second and third adjustors. The first, second and third movement blocks are disposed in the sight body. The first adjustor is coupled to the first movement block and operable to cause the first movement block to move thereby causing the illumination unit to be displaced along a first axial direction. The second adjustor is coupled to the second movement block and operable to cause the second movement block to move thereby causing the illumination unit to be displaced along a second axial direction different than the first axial direction. The third adjustor is coupled to the third movement block and operable to cause the third movement block to move thereby causing the illumination unit to be displaced along the second axial direction.

27 Claims, 12 Drawing Sheets

(56) References Cited

U.S. PATENT DOCUMENTS

| | | | | |
|---|---|---|---|---|
| 9,146,076 | B2 | 9/2015 | Jung et al. | |
| 9,574,853 | B2 | 2/2017 | Crispin | |
| 2018/0329169 | A1* | 11/2018 | Choiniere | G02B 7/008 |
| 2019/0011225 | A1* | 1/2019 | Sun | F41G 1/54 |
| 2019/0049217 | A1* | 2/2019 | Costet | F41G 1/17 |

* cited by examiner

DOT SIGHT DEVICE

CROSS REFERENCE TO RELATED APPLICATIONS

This application is a Continuation application of application Ser. No. 15/673,371 filed on Aug. 9, 2017, which claims priority to Korean Patent Application No. 10-2016-0101328, filed Aug. 9, 2016, the entirety each of which are incorporated by reference in their entirety.

BACKGROUND

The present disclosure relates to a dot sight device, and more particularly, a dot sight device capable of enabling a user to perform zeroing and bullet path compensation rapidly.

In the past, a dot sight device with an optical sighting device that employs a no-power lens or a low-power lens and uses an aiming point with no complicated line of sight has been developed.

The dot sight device with the no- or low-power lens helps the user rapidly aim at a target and is useful at a short distance or in an urgent situation.

Specifically, a time necessary to align a line of sight can be reduced, and since the user has only to match a dot reticle image with a real target, the user can be given enough time to secure a field of vision. Thus, a target can be aimed rapidly and accurately, and a field of vision necessary to determine a surrounding situation can be secured.

A dot sight device that performs zeroing by moving a light source is disclosed in Korean Patent No. 10-00906159, but in this dot sight device, adjusting units for moving the light source are arranged on different surfaces of the dot sight device. For example, the adjusting units are arranged in directions symmetrical to each other, and thus it is inconvenient to use.

A zeroing method of performing zeroing by operating the adjusting units arranged on the different surfaces causes a time delay in a situation in which rapid zeroing is required.

In addition, when the dot sight device is designed, since the adjusting units for zeroing are arranged on different surfaces, the volume of the dot sight device is increased.

A dot sight device including a zeroing mechanism and a bullet path compensating mechanism is disclosed in, for example, U.S. Pat. No. 8,087,196. However, in this dot sight device, the zeroing mechanism and the bullet path compensating mechanism are separate and there is a problem that the volume of the dot sight device is increased and the weight of the dot sight device is increased.

In light of the foregoing, it is an object of the present disclosure to provide a dot sight device capable of enabling the user to performing zeroing and bullet path compensation rapidly.

It is another object of the present disclosure to provide a light-weight compact dot sight device in which a zeroing mechanism is integrated with a bullet path compensating mechanism.

BRIEF SUMMARY

In an example, a dot sight includes a sight body, an illumination unit, an optical system, a first movement block, a second movement block, a first adjustor and a second adjustor. The sight body includes an opening operable to pass external light. The illumination unit is operable to generate light. The optical system includes a reflecting mirror operable to direct light generated by the illumination unit to exit the sight body through the opening. The first movement block is disposed in the sight body. The second movement block is disposed in the sight body. The first adjustor is coupled to the first movement block. The first adjuster is accessible from a first side of the sight body and operable to cause the first movement block to move thereby causing the illumination unit to be displaced along a first axial direction. The second adjustor is coupled to the second movement block. The second adjuster is accessible from the first side of the sight body and operable to cause the second movement block to move thereby causing the illumination unit to be displaced along a second axial direction different than the first axial direction.

In another example, an exemplary dot sight device includes a sight body, an illumination unit, an optical system, a first movement block, a second movement block, a third movement block, a first adjustor, a second adjustor, and a third adjustor. The sight body includes an opening operable to pass external light. The illumination unit is operable to generate light. The optical system includes a reflecting mirror operable to direct light generated by the illumination unit to exit the sight body through the opening. The first, second and third movement blocks are disposed in the sight body. The first adjustor is coupled to the first movement block and operable to cause the first movement block to move thereby causing the illumination unit to be displaced along a first axial direction. The second adjustor is coupled to the second movement block and operable to cause the second movement block to move thereby causing the illumination unit to be displaced along a second axial direction different than the first axial direction. The third adjustor is coupled to the third movement block and operable to cause the third movement block to move thereby causing the illumination unit to be displaced along the second axial direction.

DETAILED DESCRIPTION

Figure 1:
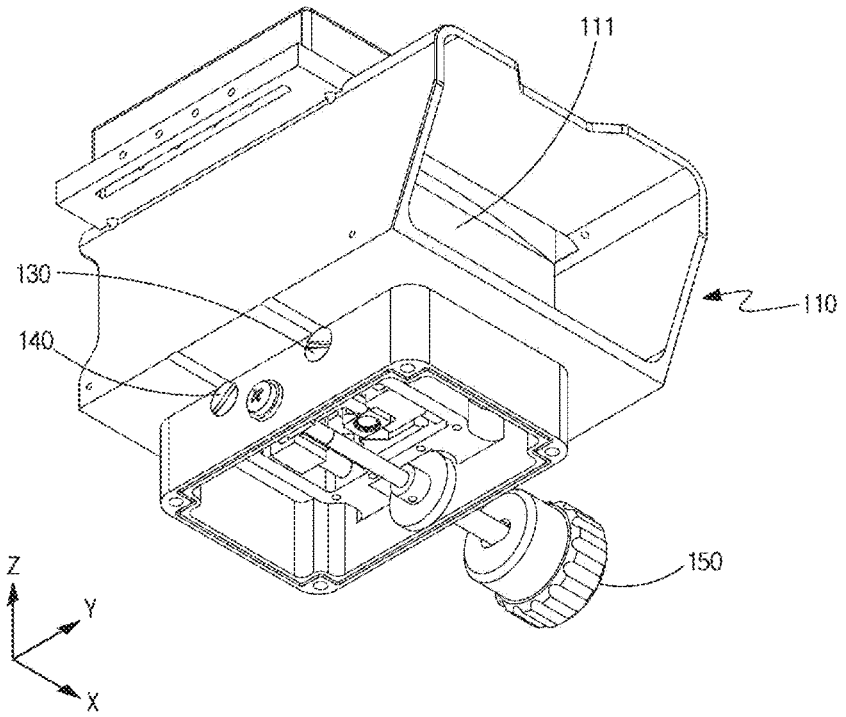
FIG. 1 is a perspective view of an exemplary dot sight device according to an embodiment of the present disclosure.

Hereinafter, an exemplary embodiment of the present disclosure will be described in detail with reference to the accompanying drawings.

In the following embodiment, a first axis indicates an X axis, a second axis indicates a Y axis, and a third axis indicates a Z axis. The second axis Y corresponds to a front and back direction parallel to a direction of the barrel, the first axis X corresponds to a left and right direction that is horizontally orthogonal to a direction of the barrel, and the third axis (Z) corresponds to an up and down direction which is orthogonal to the first axis X and the second axis Y.

Further, in the following embodiment, a term "aiming point" indicates a position at which light emitted from a light source finally reaches a window or a retina of an observer. For example, in FIG. 10C, an aiming point indicates a position of light on a circular grid. The aiming point is also referred to as a dot image viewed by the observer.

Hereinafter, a dot sight device according to an embodiment of the present disclosure will be described with reference to FIGS. 1 to 13.

The dot sight device according to the present embodiment includes a sight body 110, an aiming point generating unit 120, a zeroing unit, and a bullet path compensating unit 150. The sight body 110 includes a window 111 through which a target is aimed at. The aiming point generation unit 120 includes a light source unit 121 that is arranged inside the sight body 110 and emits light so that an aiming point is formed on the window 111. The zeroing unit is coupled with the light source unit 121 and performs zeroing by moving the light source unit 121 upwards, downwards, leftwards, or rightwards. In other words, the zeroing is performed by moving the light source unit 121 so that the aiming point on the window 111 is moved upwards, downwards, leftwards, or rightwards. The bullet path compensating unit 150 performs bullet path compensation in accordance with a distance to the target by moving the aiming point on the window 111 upwards, downwards, leftwards, or rightwards in a state in which the zeroing is completed by the zeroing unit.

The sight body 110 is detachably coupled to an arm such as a rifle or a gun not illustrated.

An observer can see the projected aiming point through the window 111, and an observer side surface of a beam splitter 123 to be described later may function as the window 111.

In addition to the light source unit 121, as illustrated in FIG. 10, the aiming point generating unit 120 includes a reflective mirror 122 and the beam splitter 123. The reflective mirror 122 is disposed on an opposite side to the light source unit 121. The beam splitter 123 is disposed between the light source unit 121 and the reflective mirror 122. The beam splitter 123 transmits at least part of the light emitted from the light source unit 121 so that at least part of the light is directed toward the reflective mirror 122. The light reflected by the reflective mirror 122 is reflected by the beam splitter toward the window 111. Accordingly, the aiming point is formed and viewed by the observer.

The light source unit 121 may include a light emitting unit that emits light and a fixing bracket to which the light emitting portion is fixed.

In the present embodiment, the light emitting unit includes an LED, but the present disclosure is not limited thereto, and various light emitting elements such as an RC LED can be used as the light emitting unit of the present embodiment.

In the present embodiment, the light source unit 121 is disposed on the bottom of the sight body 110 to emit light toward the beam splitter 123 disposed above the light source unit 121.

In the present embodiment, the reflective mirror 122 is disposed on the top of the sight body 110, that is, above the beam splitter 123 on the opposite side to the light source unit 121, and the reflective mirror 123 and the light source unit 121 are disposed on the same optical axis. In the present embodiment, a meniscus lens of a positive refracting power having a single reflection surface is used as the reflective mirror 122. However, a doublet lens may be used as the reflective mirror 122.

In the present embodiment, a beam splitting prism in which two right-angled prisms are combined is used as the beam splitter 123. Alternatively, a flat plate type beam splitter in which A % reflection coating is applied to at least one surface thereof may be used.

In other words, when A % reflection coating is applied to one of two inclined surfaces which are interfaces of the two right-angled prisms, the beam splitter 123 transmits (100−A) % of incident light and reflects A % of the incident light.

For example, when the two right-angled prisms are bonded after 50% reflective coating is applied to one of two inclined surfaces which are interfaces of the two right-angled prisms, the beam splitter 123 transmits 50% of the incident light and reflect 50% of the incident light.

In other words, at least part of the light emitted from the light source unit 121 passes through the beam splitter 123 and reaches the reflective mirror 122, and the light reflected by the reflective mirror 122 is reflected by the reflection coating and directed toward the window 111, that is, the observer.

Further, light reflected by an external target passes through the beam splitter 123 and reaches the eye of the user through the window 111.

Figure 2:
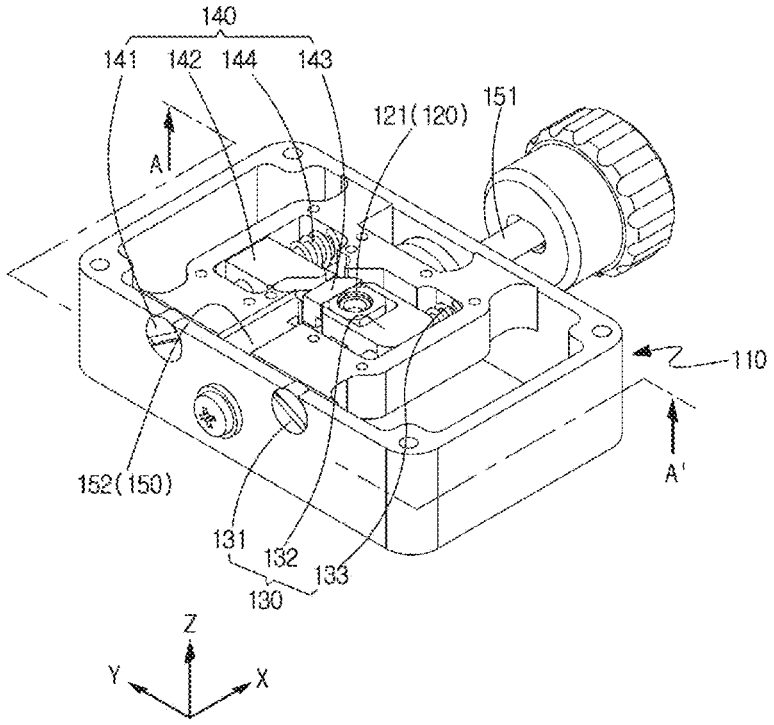
FIG. 2 is a perspective view of an exemplary dot sight device according to an embodiment of the present disclosure.

As illustrated in FIG. 2, the zeroing unit includes a first adjusting unit 130 and a second adjusting unit 140. The first adjusting unit 130 functions to move the light source unit 121 in the first axis (X) direction in order to move the aiming point on the window 111 leftwards or rightwards. The second adjusting unit 140 functions to move the light source unit 121 in the second axis (Y) direction in order to move the aiming point on the window 111 upwards or downwards.

Figure 3:
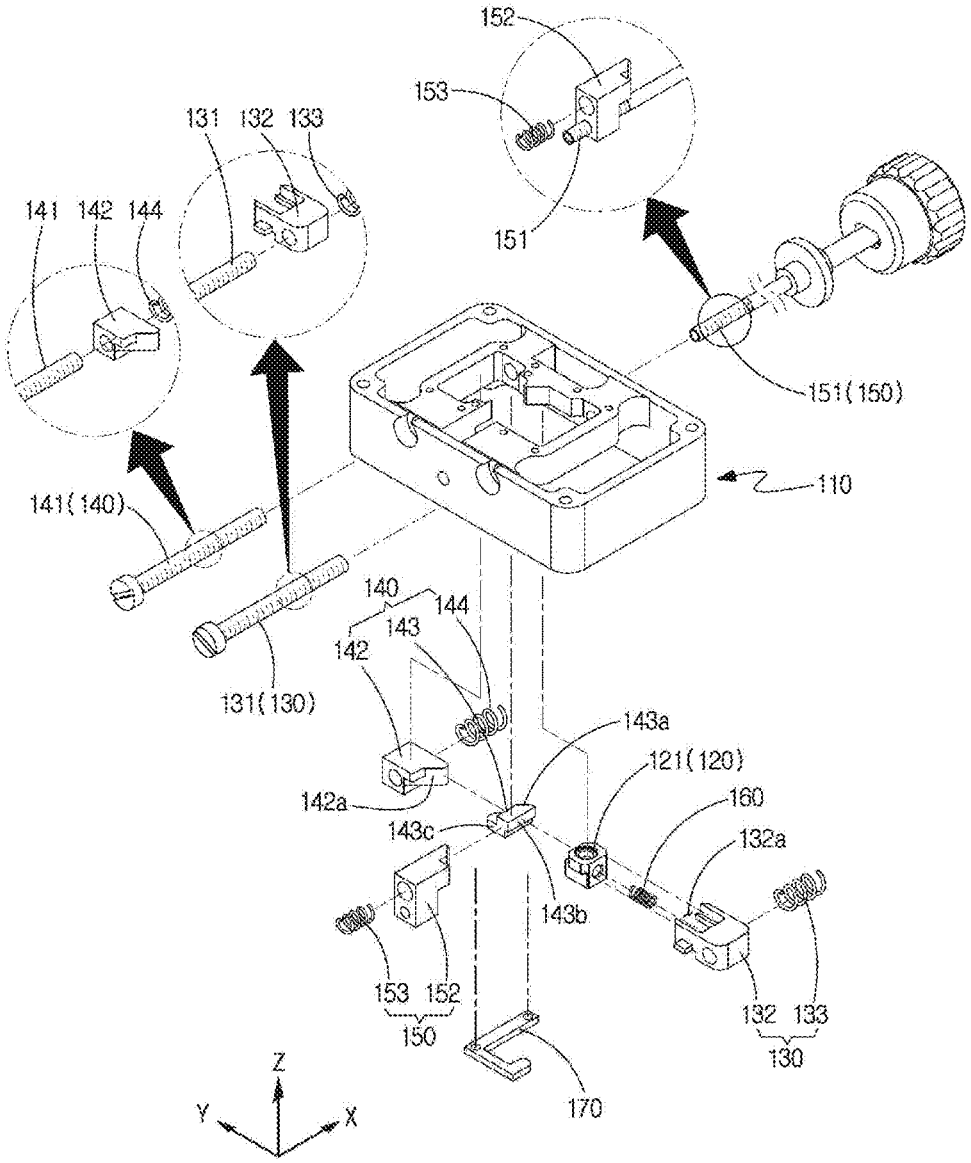
FIG. 3 is an exploded perspective view of a dot sight device according to an embodiment of the present disclosure.

As illustrated in FIG. 3, the first adjusting unit 130 includes a first shaft 131, a first movement block 132, and a first pressing member 133. The first shaft 131 extends in the first axis (X) direction, includes a threaded outer circumferential surface, and is rotatably supported on the sight body 110. The first movement block 132 is screw-coupled with the first shaft 131 and linearly moves in the first axis (X) direction with the rotation of the first shaft 131. The first pressing member 133 is interposed between the first movement block 132 and the sight body 110 and elastically presses the first movement block 132 in one direction parallel to the first axis X, that is, the −X axis direction. A coil-like spring may be used as the first pressing member 133.

In the present embodiment, the first shaft 131 includes a slotted screw head for rotating the first shaft 131. Alternatively, an adjusting knob for rotating the first shaft 131 may be formed on one end of the first shaft 131 to be exposed from one side of the sight body 110.

The first movement block 132 linearly moves with the rotation of the first shaft 131.

Figure 6:
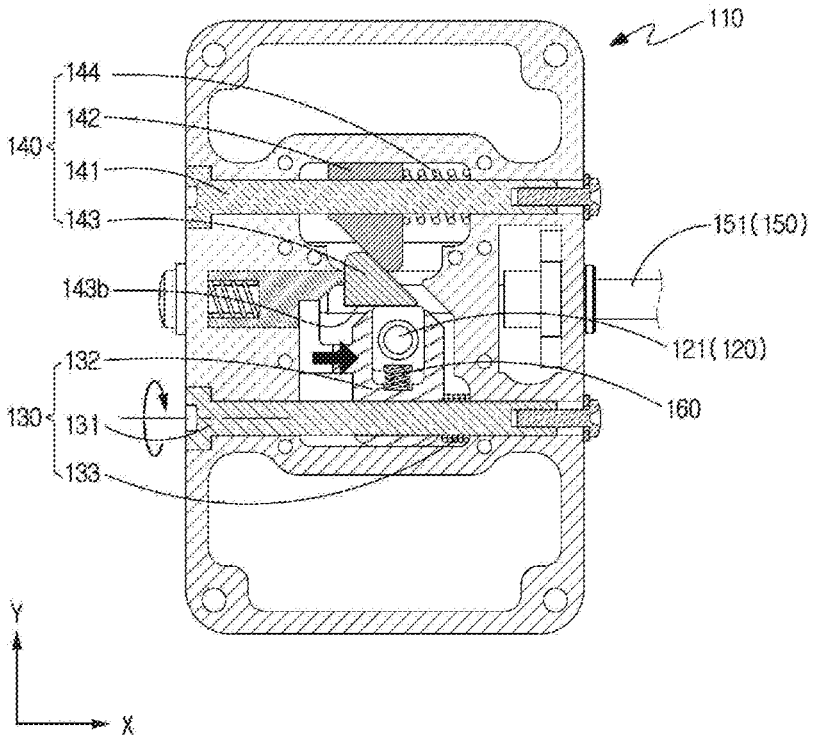
FIG. 6 is a plane view of a dot sight device according to an embodiment of the present disclosure illustrating an operation of a first adjusting unit.

As illustrated in FIG. 6, as the first movement block 132 linearly moves in the first axis (X) direction with the rotation of the first shaft 131, the light source unit 121 coupled with a guide 132*a* of the first movement block 132 moves in the first axis (X) direction together with the first movement block 132.

The movement of the light source unit 121 in the first axis (X) direction by the first adjusting unit 130 causes the aiming point on the window 111 to move in the first axis (X) direction as illustrated in FIGS. 10 and 11.

Figure 10A:
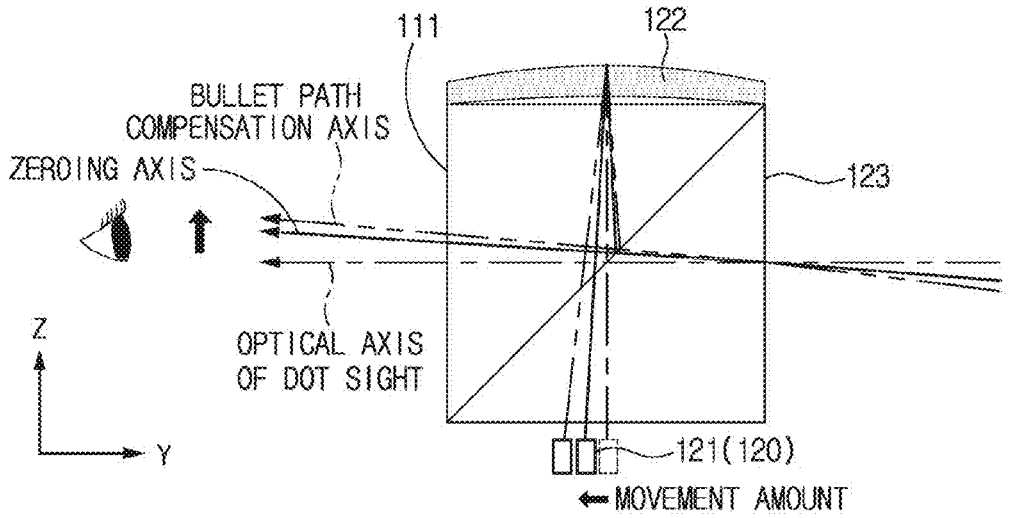
FIG. 10A is a diagram illustrating a state in which an aiming point is moved by a zeroing unit or a bullet path compensating unit.
Figure 10B:
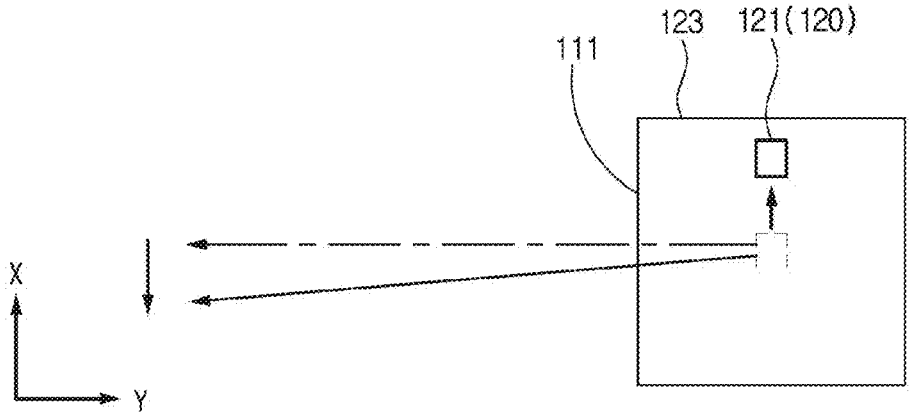
FIG. 10B is a diagram illustrating a state in which an aiming point is moved by a zeroing unit or a bullet path compensating unit.
Figure 10C:
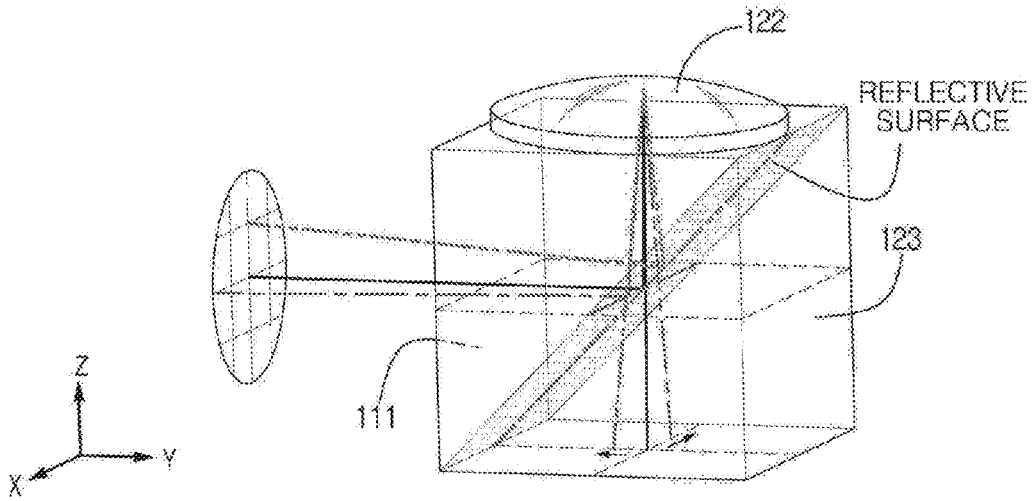
FIG. 10C is a diagram illustrating a state in which an aiming point is moved by a zeroing unit or a bullet path compensating unit.

Specifically, when the light source unit 121 is moved in the +X axis direction, the aiming point rotates in the −X axis direction in the window 111 as illustrated in FIG. 10B, whereas the light source unit 121 is moved in the −X axis direction, the aiming point rotates in the +X axis direction in the window 111 as illustrated in FIG. 10C.

Since the first movement block 132 is screw-coupled to the threaded surface of the first shaft 131, the first movement block 132 may slightly move in the first axis (X) direction within an assembly tolerance for engagement of a male screw and a female screw, and in this case, the aiming accuracy may be lowered.

However, since the first movement block 132 is elastically supported by the first pressing member 133 in one direction on the first axis X, the first movement block 132 is moved in one direction in a state in which the male screw and the female screw are brought into close contact with each other, and thus the aiming accuracy is reduced or prevented from being lowered due to the assembly tolerance for the engagement of the male screw and the female screw.

As illustrated in FIG. 3, the second adjusting unit 140 includes a second shaft 141, a second movement block 142, a third movement block 143, and a second pressing member 144. The second shaft 141 extends in the first axis (X) direction, includes a threaded outer circumferential surface, and is rotatably supported on the sight body 110. The second movement block 142 is screw-coupled with the second shaft 141 and linearly moves in the first axis (X) direction with the rotation of the second shaft 141. The third movement block 143 is interposed between the second movement block 142 and the light source unit 121 and moves in the second axis (Y) direction with the movement of the second movement block 142, and the second pressing member 144 is interposed between the second movement block 142 and the sight body 110 and elastically press the second movement block 142 in one direction parallel to the first axis X, that is, the −X axis direction.

The second shaft 141 is disposed in parallel to the first shaft 131, and in this case, it is convenient to perform zeroing. In the present embodiment, the second shaft 141 includes a slotted screw head for rotating the second shaft 141. Alternatively, an adjusting knob for rotating the second shaft 141 may be formed on one end of the second shaft 141 to be exposed from one side of the sight body 110.

Figure 4:
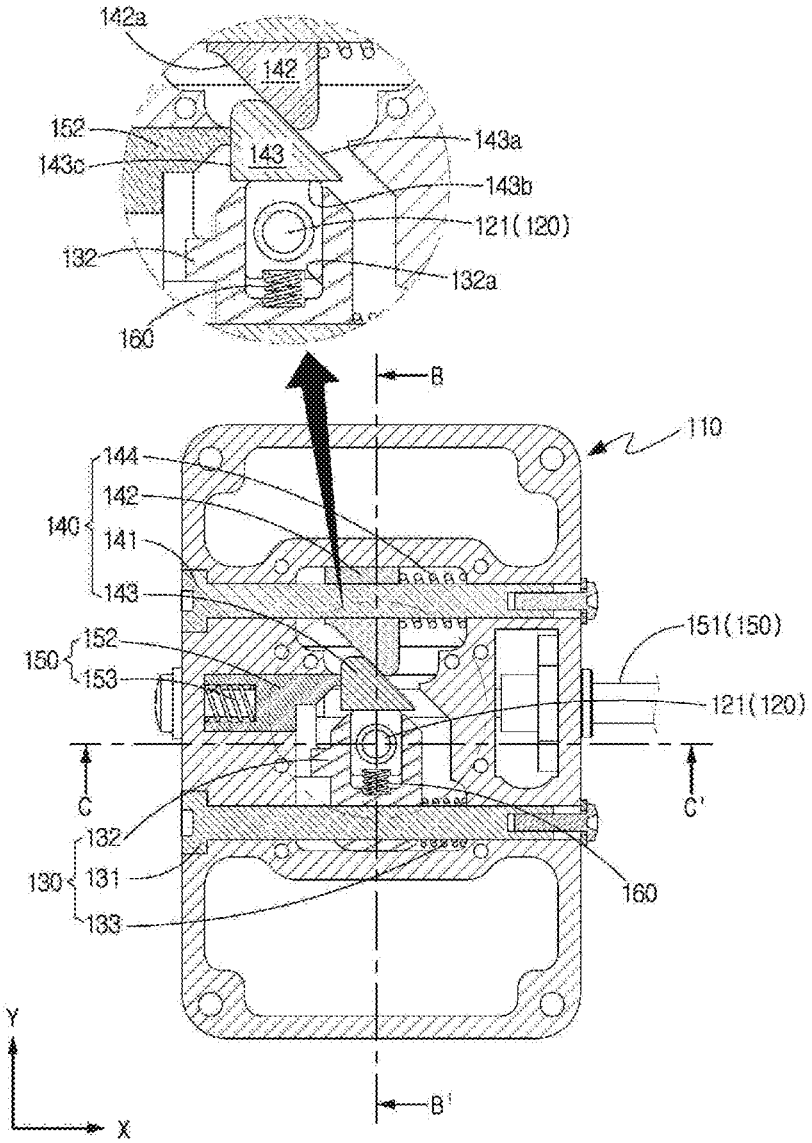
FIG. 4 is a plane view of a dot sight device according to an embodiment of the present disclosure.
Figure 5:
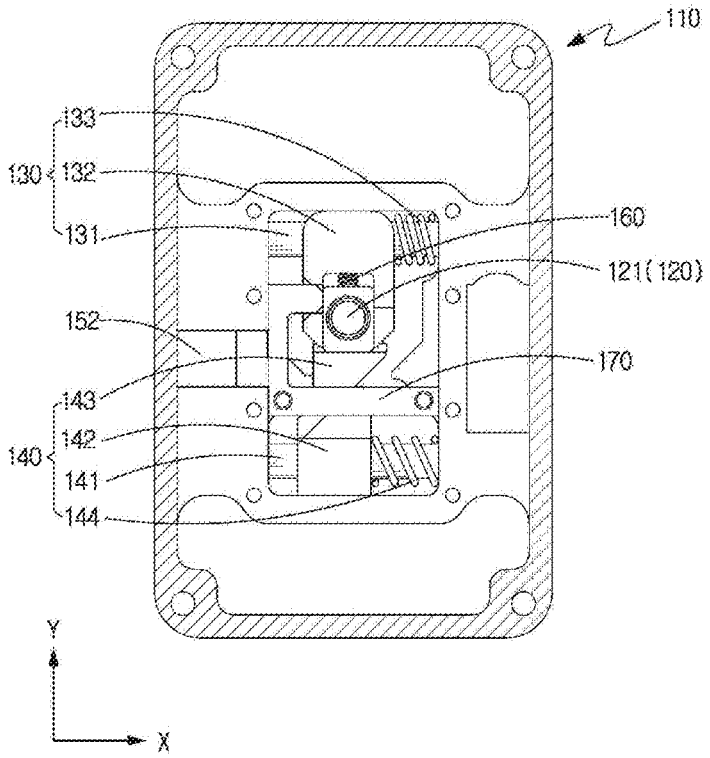
FIG. 5 is a cross-sectional view taken along line A-A' of FIG. 2.

The second movement block 142 linearly moves with the rotation of the second shaft 141. As illustrated in FIG. 4, a contact surface of the second movement block 142 and a contact surface of the third movement block 143 include a first inclined surface 142*a* and a second inclined surface 143*a* which are inclined at 45° with respect to the first axis (X) direction and the second axis (Y) direction so that the third movement block 143 moves in the second axis (Y) direction with the movement of the second movement block 142 in the first axis (X) direction.

The third movement block 143 has a substantially right-angled triangular cross section at a plane view. At the plane view of FIG. 3, a first guide surface 143*b* is formed in the first axis (X) direction as a surface facing the light source unit 121, and a second guide surface 143*c* is formed in the second axis (Y) direction as a surface facing the bullet path compensating unit 150 to be described later.

As illustrated in FIG. 3, the guide 132*a* of the first movement block 132 includes a guide recess having a letter "U" shape in which the light source unit 121 is insertable or movable in the second axis (Y) direction, and surrounds the light source unit 121 when the light source unit 121 is inserted into the guide 132*a*. An elastic member 160 is interposed between the first movement block 132 and the light source unit 121, and thus the light source unit 121 inserted into the guide 132*a* is elastically supported toward the third movement block 143 in the guide recess of the guide 132*a*. A coil-like spring may be used as the elastic member 160.

Specifically, one end of the elastic member 160 is supported by the first movement block 132 in the guide 132*a*, and the other end of the elastic member 160 is supported by the light source unit 121, and thus the elastic member 160 elastically presses the light source unit 121 toward the third movement block 143.

In other words, one side of the light source unit 121 inserted into the guide 132*a* of the first movement block 132 to be movable in the second axis (Y) direction is supported by the elastic member 160 in the guide recess of the guide 132*a*, and the other side of the light source unit 121 is brought into close contact with the third movement block 143.

As illustrated in 7, when the second movement block 142 moves in the first axis (X) direction (that is, the +X axis direction) with the rotation of the second shaft 141, the third movement block 143 and the light source unit 121 move in the second axis (Y) direction (that is, the +Y axis direction) by the elastic force of the elastic member 160.

The movement of the light source unit 121 in the second axis (Y) direction by the second adjusting unit 140 causes the aiming point on the window 11 to move in the up and down direction, that is, the third axis (Z) direction as illustrated in FIG. 10A.

The second pressing member 144 may be a coil-like spring into which the second shaft 141 is inserted. The second pressing member 144 is used to reduce or prevent the aiming accuracy from being lowered due to the assembly tolerance of the second movement block 142 and the second shaft 141, similarly to the first pressing member 133.

The bullet path compensating unit 150 functions to compensate the bullet path in accordance with the distance to the target by moving the light source unit 121 so that the aiming point on the window 111 is moved in the state in which the zero is set by the zeroing unit. As illustrated in FIG. 3, the bullet path compensating unit 150 includes a third shaft 151, a fourth movement block 152, and a third pressing member 153. The third shaft 151 extends in the first axis (X)

direction, includes a threaded outer circumferential surface, and is rotatably supported on the sight body 110. The fourth movement block 152 is screw-coupled with the third shaft 151 and linearly moves in the first axis (X) direction with the rotation of the third shaft 151 to move the third movement block 143 in the first axis (X) direction. The third pressing member 153 is interposed between the fourth movement block 152 and the sight body 110 and elastically press the fourth movement block 152 in one direction parallel to the first axis X, that is, the +X axis direction.

In the present embodiment, an adjusting knob for rotating the third shaft 151 is formed at one end of the third shaft 151 to be exposed from the sight body 110. The fourth movement block 152 linearly moves with the rotation of the third shaft 151.

Here, the fourth movement block 152 is spaced apart from the first inclined surface 142*a* of the second movement block 142 with the third movement block 143 interposed therebetween.

In other words, in the third movement block 143, the second guide surface 143*c* comes into contact with the fourth movement block 152 in the state in which the second inclined surface 143*a* is brought into close contact with the first inclined surface 142*a* of the second movement block 142. Thus, as illustrated in FIGS. 8 and 9, when the fourth movement block 152 moves in the first axis (X) direction with the rotation of the third shaft 151, the third movement block 143 slidingly moves along the first inclined surface 142*a* of the second movement block 142, and the light source unit 121 which is brought into close contact with the third movement block 143 due to the elastic force of the elastic member 160 in the guide 132*a* moves in the second axis (Y) direction by a movement amount of the third movement block 143 in the second axis (Y) direction.

The movement of the light source unit 121 in the second axis (Y) direction by the bullet path compensating unit 150 causes the aiming point on the window 11 to move in the up and down direction, that is, the third axis (Z) direction.

Figure 8:
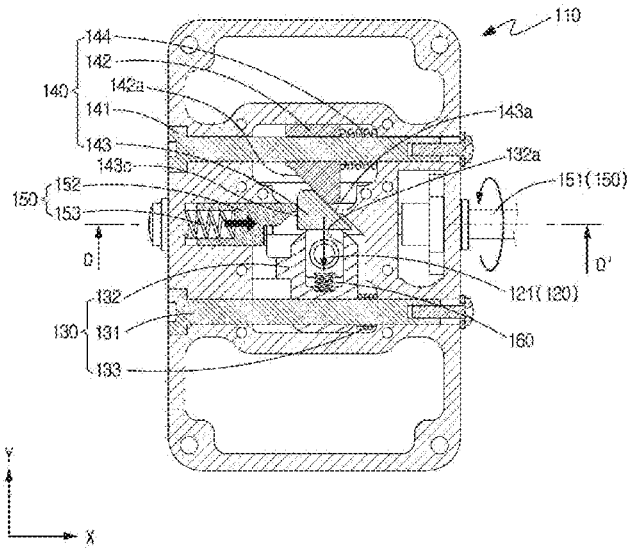
FIG. 8 is a plane view of a dot sight device according to an embodiment of the present disclosure illustrating an operation of a bullet path compensating unit.
Figure 9:
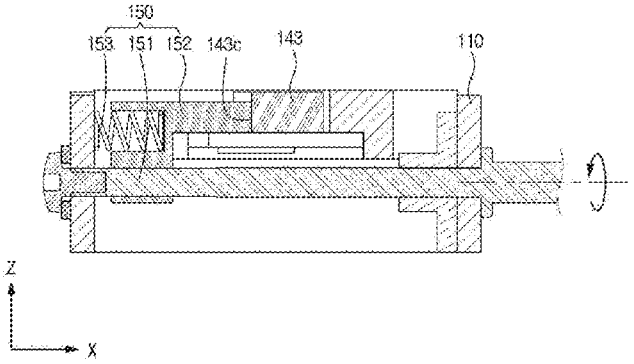
FIG. 9 is a sectional view taken along the line D-D' of FIG. 8.

In the present embodiment, as illustrated in FIGS. 8 and 10, when the third shaft 151 rotates using the adjusting knob in the state in which the rotations of the first shaft 131 and the second shaft 141 (the zeroing unit) are fixed, that is, the state in which the zero is set, the light source unit 121 first moves in the −Y axis direction, and the bullet path compensation axis moves in the +Z axis, and the distance to the target is increased with the clockwise rotation.

Figure 11A:
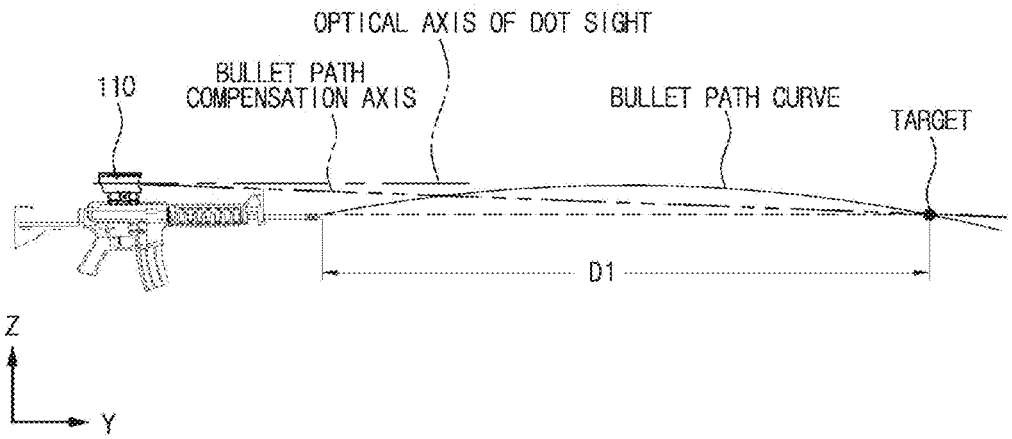
FIG. 11A is a diagram illustrating bullet path compensation performed by a bullet path compensating unit.
Figure 11B:
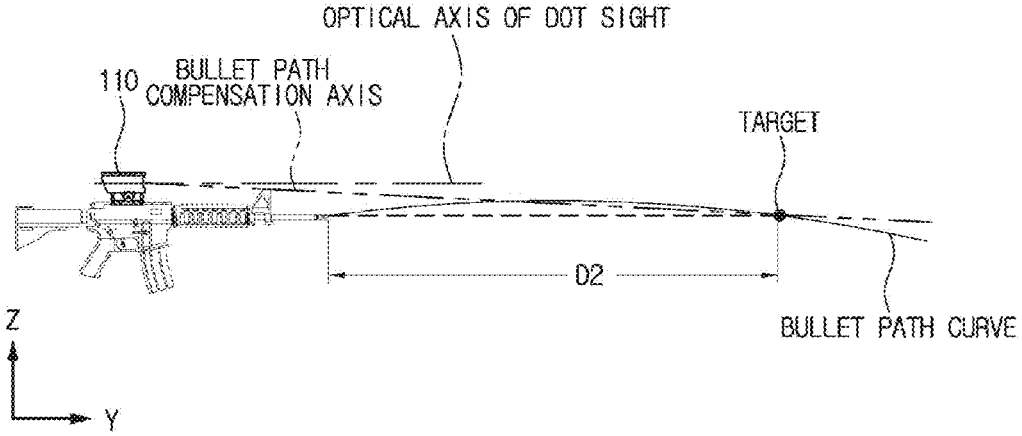
FIG. 11B is a diagram illustrating bullet path compensation performed by a bullet path compensating unit.

Accordingly, by rotating the adjusting knob in accordance with distances D1 and D2 to the target, the aiming point on the window 111 is moved in the up and down direction, that is, the Y axis direction, and thus the aiming angle of the arm can be compensated in accordance to the distance to the target as illustrated in FIGS. 11A and 11B.

In other words, when the target is aimed at using the aiming point on the bullet path compensation axis moving in the third axis (Z) direction in accordance with the distance from the target, the bullet path curve of the arm intersects with the target.

The third pressing member 153 may be a coil-like spring into which the third shaft 151 is inserted. The third pressing member 153 is used to prevent the aiming accuracy from being lowered due to the assembly tolerance of the fourth movement block 152 and the third shaft 1511, similarly to the first pressing member 133.

Although not illustrated, in the present embodiment, it is preferable to form an indicator indicating distances on the adjusting knob so that the bullet path compensation can be performed rapidly in accordance with the distance to the target.

Further, an engagement portion is formed on each of a contact surface between the first movement block 132 and the light source unit 121, a contact surface between the light source unit 121 and the third movement block 143, and a contact surface between the third movement block 143 and the second movement block 142. In the present embodiment, the engagement portions include engagement protrusions which are engaged with each other in the third axis (Z) direction.

Figure 12:
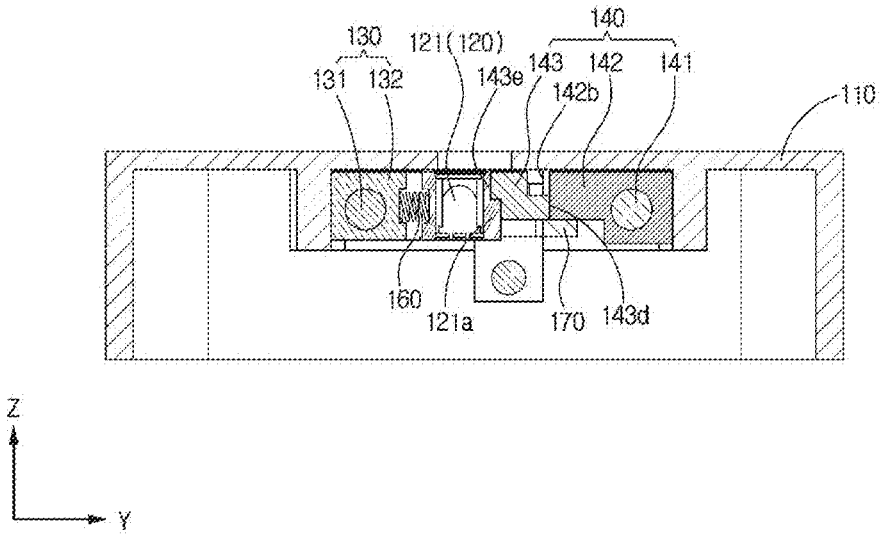
FIG. 12 is a cross-sectional view taken along the line B-B' of FIG. 4.
Figure 13:
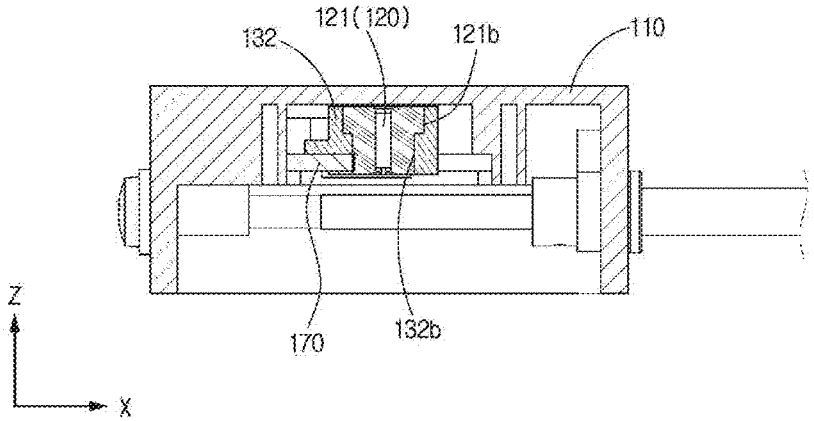
FIG. 13 is a cross-sectional view taken along the line C-C' of FIG. 4.

Specifically, as illustrated in FIGS. 12 and 13, engagement protrusion 142*b* of the second movement block 142 is engaged with an engagement protrusion 143*d* of the third movement block 143, an engagement protrusion 143*e* of the third movement block 143 is engaged with an engagement protrusion 121*a* of the light source unit 121, and an engagement protrusion 121*b* of the light source unit 121 is engaged with an engagement protrusion 132*b* of the first movement block 132.

In other words, the second movement block 142, the third movement block 143, the light source unit 121, and the first movement block 132 are interposed between the fixing block 170 and the sight body 110 in the state in which they are sequentially engaged with each other in the third axis (Z) direction, their movement in the third axis (Z) direction is efficiently restricted.

The movement of the first movement block 132, the second movement block 142, the third movement block 143, and the fourth movement block 152 in the first axis (X) direction or the second axis (Y) direction is guided in the state in which they are interposed between the sight body 110 and the fixing block 170.

An operation of the dot sight device according to the present embodiment will now be described below.

The dot sight device of the present embodiment may employ an optical system having an arrangement structure of an aiming point generating unit, a reflective mirror, and a beam splitter in a dot sight device.

FIG. 10C illustrates a light path in the dot sight device according to the present embodiment.

Referring to FIG. 10C, when the light source unit 121 is moved on the −X axis direction, the aiming point is moved in the +X axis direction as indicated by a single dashed line, whereas when the light source unit 121 is moved in the −Y axis direction, the aiming point is moved in the +Z axis direction as indicated by a double dashed line.

An operation of the dot sight device according to the present embodiment will be described below in detail.

In the case of moving the aiming point on the window 111 rightwards or leftwards in order to perform the zeroing, when the first shaft 131 of the first adjusting unit 130 is rotated as illustrated in FIG. 6, the first movement block 132 moves in the first axis (X) direction with the rotation of the first shaft 131, and thus the light source unit 121 coupled with the guide 132*a* of the first movement block 132 is moved in the first axis (X) direction.

As the light source unit 121 is moved in the first axis (X) direction, the aiming point is moved in the first axis (X) direction as shown in FIGS. 10B and 10C.

Specifically, when the light source unit 121 is moved in the +X axis direction, an optical axis of light reflected by the reflective mirror 122 pivots on a central point of the reflective mirror 122 in the −X axis direction, and the aiming point is moved in the −X axis direction on the window 111 as illustrated in FIG. 10C, and when the light source unit 121 is moved in the −X axis direction, the optical axis of light reflected by the reflective mirror 122 pivots on a central point of the reflective mirror 122 in the +X axis direction, and the aiming point is moved in the +X axis direction in the window 111 as illustrated in FIG. 10C. Here, the optical axis of the light reflected by the reflective mirror 122 is, for example, an optical axis of light indicated by an optical axis of a dot sight, a zeroing axis, or a bullet path compensation axis in FIG. 10A. For example, as illustrated in FIG. 10A, as the light source unit 121 is moved in the −Y axis direction, the optical axis of the light reflected by the reflective mirror 122 pivots from the optical axis of the dot sight to the zeroing axis and from the zeroing axis to the bullet path compensation axis.

Figure 7:
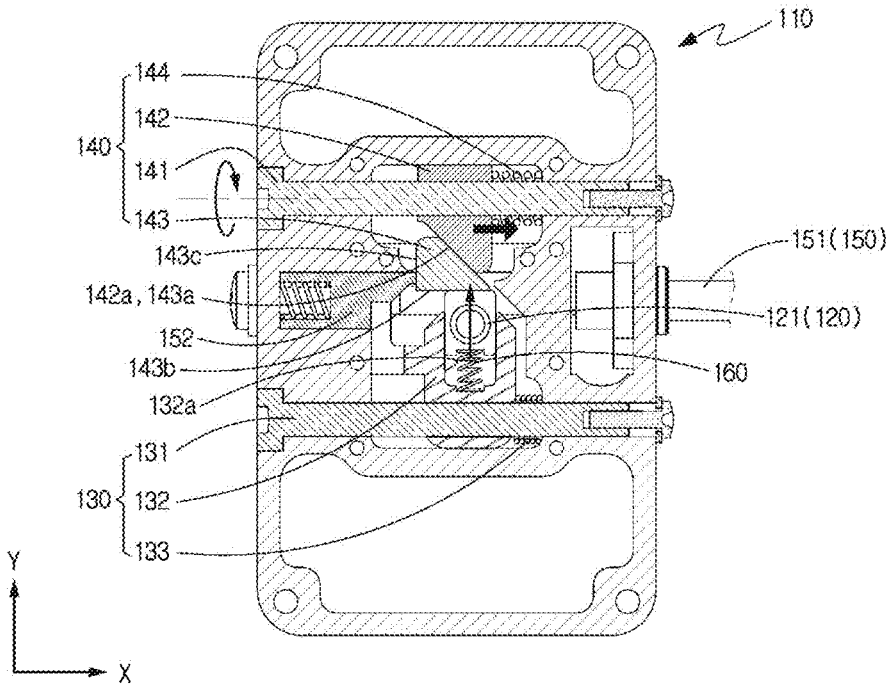
FIG. 7 is a plane view of a dot sight device according to an embodiment of the present disclosure illustrating an operation of a second adjusting unit.

In the case of moving the aiming point on the window 111 upwards or downwards in order to perform the zeroing, when the second shaft 141 of the second adjusting unit 140 is moved as illustrated in FIG. 7, the second movement block 142 is moved in the first axis (X) direction with the rotation of the second shaft 141, and the light source unit is moved in the second axis (Y) direction together with the third movement block 143.

As the light source unit 121 is moved in the second axis (Y) direction, the optical axis of the light reflected by the reflective mirror pivots in the third axis (Z) direction, and the aiming point is moved in the up and down direction parallel to the third axis (Z) as illustrated in FIG. 10A.

In other words, the movement of the light source unit 121 in the −Y axis direction causes the aiming point to move in the +Z axis direction in the window 111 as illustrated in FIGS. 10A and 10C.

In the case of moving the aiming point in the window 111 in order to perform the bullet path compensation, when the third shaft 151 of the bullet path compensating unit 150 is rotated as illustrated in FIGS. 8 and 9, the fourth movement block 152 is moved in the first axis (X) direction with the rotation of the third shaft 151, and the third movement block 143 is slidingly moved along the first inclined surface 142*a* of the second movement block 142 with the movement of the fourth movement block 152.

At this time, since the light source unit 121 is elastically supported by the elastic member 160 in the guide 132*a* of the first movement block 132 and brought into close contact with the third movement block 143, the light source unit 121 is moved in the second axis (Y) direction by the movement amount of the third movement block 143 in the second axis (Y) direction.

As the light source unit 121 is moved in the second axis (Y) direction by the bullet path compensating unit 150 as described above, the optical axis of the light reflected by the reflective mirror pivots in the third axis (Z) direction, and the aiming point on the window 111 is additionally moved upwards or downwards as illustrated in FIG. 10A.

In other words, the further movement of the light source unit 121 in the −Y axis direction for the bullet path compensation causes the aiming point on the window 111 to further move in the +Z axis direction as illustrated in FIGS. 10A and 10C.

Particularly, in the bullet path compensation process using the bullet path compensating unit 150, the position of the light source unit 121 in the second axis (Y) direction is adjusted by moving the third movement block 143 using the fourth movement block 152 in the state in which the positions of the first movement block 132 and the second movement block 142 at which the zeroing is completed are maintained as is.

In other words, since the zeroing unit and the bullet path compensating unit 150 are integrated, it is possible to implement the light-weighted compact dot sight device. In addition, since the zeroing unit and the bullet path compensating unit 150 are interlocked with each other, it is possible to reduce or prevent a state in which the zero is set from being released by the bullet path compensation.

In the dot sight device according to the present embodiment, the first adjusting unit 130 for moving the light source unit 121 of the aiming point generating unit 120 in the first axis (X) direction and the second adjusting unit 140 for moving the light source unit 121 of the aiming point generating unit 120 in the second axis (Y) direction are disposed to be adjacent to each other on one surface. Thus, the user is able to adjust the position of the aiming point upwards, downwards, leftwards, or rightwards rapidly, and it is possible to perform the zeroing easily and rapidly.

In addition, the third movement block 143 for deciding the position of the light source unit 121 in the second axis (Y) direction is moved with the movement of the second movement block 142 of the zeroing unit and the movement of the fourth movement block 152 of the bullet path compensating unit 150. The position of the second movement block 142 is maintained during the bullet path compensation process, and the zeroing is prevented from being changed during the bullet path compensation process.

Moreover, since the zeroing unit and the bullet path compensating unit 150 are disposed in the sight body 110 together, it is possible to achieve the light-weighted compact dot sight device.

Preferred exemplary embodiments of the present disclosure are described for illustrative purposes, and the scope of the present disclosure is not limited to the above described specific examples. It will be apparent to those skilled in the art that various variations and modifications may be made without departing from the spirit and scope of the disclosure as defined in the following claims.

What is claimed is:

1. A dot sight, comprising:

a sight body having an opening operable to pass light;

an illumination unit operable to generate light;

an optical system operable to direct light generated by the illumination unit to exit the sight body through the opening;

a first adjustor accessible from a first side of the sight body and operable to cause the illumination unit to be displaced along a first direction; and a second adjustor accessible from the first side of the sight body and operable to cause the illumination unit to be displaced along a second direction different than the first direction.

2. The dot sight of claim 1, wherein the first adjustor is operable to cause a first movement block to move thereby causing the illumination unit to be displaced along the first direction.

3. The dot sight of claim 1, wherein the second adjustor is operable to cause a second movement block to move thereby causing the illumination unit to be displaced along the second direction.

4. The dot sight of claim 3, wherein the second movement block includes an inclined surface.

5. The dot sight of claim 4, further comprising a third movement block disposed between the illumination unit and the second movement block, the third movement block including an inclined surface disposed proximal to the inclined surface of the second movement block.

6. The dot sight of claim 1, wherein the first adjustor is operable to rotate with respect the sight body and the rotation causes the illumination unit to move.

7. The dot sight of claim 1, wherein the second adjustor is operable to rotate with respect the sight body and the rotation causes the illumination unit to move.

8. The dot sight of claim 1, wherein the first adjustor and the second adjustor are respectively operable to rotate with respect the sight body, and an axis of rotation of the first adjustor is substantially parallel to an axis of rotation of the second adjustor.

9. The dot sight device of claim 1, further comprising a third adjustor operable to cause the illumination unit to be displaced along the second direction.

10. The dot sight device of claim 9, wherein the third adjustor is accessible from a second side of the sight body different from the first side of the sight body.

11. The dot sight device of claim 3, further comprising a third adjustor operable to cause the illumination unit to be displaced along the second direction.

12. The dot sight device of claim 11, further comprising:

a third movement block disposed between the illumination unit and the second movement block; and a fourth movement block coupled to the third adjustor, wherein the second adjustor is operable to cause the second movement block to move thereby causing the third movement block to move thereby causing the illumination unit to be displaced along the second direction, and the third adjustor is operable to cause the fourth movement block to move thereby causing the third movement block to move thereby causing the illumination unit to be displaced along the second direction.

13. The dot sight device of claim 12, wherein the second movement block includes an inclined surface, and the third movement block includes an inclined surface disposed proximal to the inclined surface of the second movement block.

14. The dot sight device of claim 13, wherein the fourth movement block is disposed proximal a side of the third movement block.

15. The dot sight device of claim 2, wherein the illumination unit is disposed within a cavity of the first movement block.

16. The dot sighting device of claim 1, wherein the optical system includes a reflecting element operable to reflect light generated by the illumination unit.

17. A dot sight, comprising:

a sight body having an opening operable to pass external light;

an illumination unit operable to generate light;

an optical system operable to direct light generated by the illumination unit to exit the sight body through the opening;

a first adjustor operable to cause the illumination unit to be displaced along a first direction;

a second adjustor operable to cause the illumination unit to be displaced along a second direction different than the first direction; and a third adjustor coupled to a movement block, the third adjustor being operable to cause the movement block to move thereby causing the illumination unit to be displaced along the second direction.

18. The dot sight device of claim 17, wherein the first adjuster and second adjustor are accessible from a same side of the sight body.

19. The dot sight device of claim 17, wherein the third adjustor is accessible from a different side of the sight body.

20. The dot sight of claim 17, wherein the first adjustor is operable to cause a first movement block to move thereby causing the illumination unit to be displaced along the first direction, and the second adjustor is operable to cause a second movement block to move thereby causing the illumination unit to be displaced along the second direction.

21. The dot sight device of claim 20, wherein the illumination unit is disposed within a cavity of the first movement block.

22. The dot sight of claim 20, wherein the second movement block includes an inclined surface.

23. The dot sight of claim 22, further comprising a third movement block disposed between the illumination unit and the second movement block, the third movement block including an inclined surface disposed proximal to the inclined surface of the second movement block.

24. The dot sight of claim 23, wherein the movement block is disposed proximal to a side of the third movement block.

25. The dot sight of claim 17, wherein the first adjustor is operable to rotate with respect to the sight body and the rotation causes the first movement block to move, and the second adjustor is operable to rotate with respect to the sight body and the rotation causes the second movement block to move.

26. The dot sight of claim 25, wherein an axis of rotation of the first adjustor is substantially parallel to an axis of rotation of the second adjustor.

27. The dot sight of claim 17, wherein the third adjustor is operable to rotate with respect to the sight body and the rotation causes the movement block to move.

* * * * *